United States Patent [19]

Tschirch et al.

[11] 4,454,611

[45] Jun. 19, 1984

[54] HEAT RESISTANT PROTECTIVE HAND COVERING

[75] Inventors: Richard P. Tschirch, Westwood; Kenneth R. Sidman, Wayland; Irving J. Arons, Peabody, all of Mass.

[73] Assignee: The United States of America as represented by the United States National Aeronautics and Space Administration, Washington, D.C.

[21] Appl. No.: 393,586

[22] Filed: Jun. 30, 1982

[51] Int. Cl.[3] ..... A41D 19/00

[52] U.S. Cl. ..... 2/161 R; 2/164; 2/167

[58] Field of Search ..... 2/170, 162, 158, 164, 2/167, 161 R, 243, 2.5, 16, 20

[56] References Cited

U.S. PATENT DOCUMENTS

| | | | |
|---|---|---|---|
| 2,327,625 | 8/1943 | Dickson | 2/161 R |
| 2,988,457 | 6/1961 | Gatcomb | 2/167 X |
| 2,999,764 | 9/1961 | Rhoads | 2/167 X |
| 3,026,531 | 3/1962 | Holaday | 2/167 |
| 3,787,897 | 1/1974 | Sabin et al. | 2/167 X |
| 4,004,295 | 1/1977 | Byrnes, Sr. | 2/161 R |
| 4,302,851 | 12/1981 | Adair | 2/167 |

*Primary Examiner*—Werner H. Schroeder
*Assistant Examiner*—Tracy Graveline
*Attorney, Agent, or Firm*—Edward K. Fein; John R. Manning; Marvin F. Matthews

[57] ABSTRACT

A heat-resistant, protective glove having a shell made of a fabric of a temperature-resistant aromatic polyamide fiber, the outer surface of the shell being coated with a fire-resistant elastomer and a liner, generally conforming and secured to the shell and disposed inwardly of the shell, the liner being made of a felt fabric of a temperature-resistant aromatic polyamide fiber.

9 Claims, 3 Drawing Figures

HEAT RESISTANT PROTECTIVE HAND COVERING

ORIGIN OF THE INVENTION

The invention described herein was made in the performance of work under a NASA contract and is subject to the provisions of Section 305 of the National Aeronautics and Space Act of 1958, Public Law 85-568 (72 Stat 435, 42 U.S.C. 2457).

BACKGROUND OF THE INVENTION

1. Field of the Invention

The present invention relates to protective hand coverings such as gloves, mitts and the like and, more particularly, to gloves that provide improved levels of protection against cutting, puncturing or burning of the hands of the wearer.

Fireman, foundry workers, workers who work around furnaces or similar industrial installation are necessarily exposed to handling hot objects or direct exposure to flame or a high degree of heat which can quickly cause severe burns. In particular, fire fighters are continually exposed to a variety of hazards capable of causing substantial injury. Cuts, lacerations, and punctures result from contacts with broken glass, sharp metal and plastic objects, nail and wood splinters encountered in nearly all structural fires. Burns, whether from radiant thermal energy, hot objects or open flame, can occur in any fire. In addition, fire fighters can be exposed to electricity and hazardous liquids while fighting structural fires. All of these hazards are often obscured by poor lighting or smoke and, therefore, become even more dangerous.

Hazardous conditions are compounded by debris, soot, and water or other extinguishing agents that normally cover and permeate everything at and adjacent to a fire scene, including the fire fighters. Consequently, discomfort can be severe, adding to both fire fighter's stress and reduced alertness. These conditions contribute to fire fighters' susceptibility to injury by fire-scene hazards.

Accordingly, suitable protective garments, including gloves, are absolutely necessary to protect the fire fighter from severe injury in the performance of his duty. Such gloves must be fire and heat-resistant, resistant to cuts and punctures and not adversely affect comfort and dexterity.

2. Description of the Prior Art

The prior art, as exemplified by U.S. Pat. Nos. 1,730,763, 2,304,137, 2,650,365, 3,883,898, 4,004,295 and 4,302,851 all disclose various types of heat, flame and/or cut and puncture resistant gloves made of various materials.

U.S. Pat. No. 1,730,763 to Gerding discloses a protective glove for use against fire comprising an outer layer of woven or knitted asbestos fabric and an inner layer made of various materials such as cotton, wool, leather or any woven or knitted fabric having more cohesiveness or tensile strength than asbestos.

U.S. Pat. No. 2,304,137 to Peakes discloses a protective glove comprising an inner glove which is made of a layer of cotton fabric, balloon cloth or the like, coated with a viscous rubber layer, the inner glove being inserted into an outer wear resistant glove of any suitable type such as cotton fabric.

U.S. Pat. No. 4,302,851 to Adair discloses a high temperature protective mitt or glove of which the main outer layer is made of woven Kevlar fibers, the main outer layer also having a lining made of a layer of wool knit fabric.

While the prior art discussed above has, to some extent, overcome some of the difficulties in providing effective, protective hand apparel for fire fighters and the like, the need to constantly improve such apparel is readily apparent.

SUMMARY OF THE INVENTION

It is therefore an object of the present invention to provide protective hand apparel such as mitts or gloves which are heat and flame-resistant and which are resistant to cutting and puncturing.

Another object of the present invention is to provide protective hand apparel made of a coated fabric which affords comfort and dexterity to the wearer while providing protection against heat, flames, cuts and punctures.

The above and other objects of the present invention will become apparent from the drawings, the description given herein and the appended claims.

The heat-resistant, protective glove of the present invention is comprised of a shell having an inner surface and an outer surface, the shell generally defining a palm side, a backside and an opening for insertion of the wearer's hand. The shell is made of a fabric of a temperature-resistant polyamide fiber. The outer surface of the shell is coated with a flame-resistant elastomer. The glove also has a liner which overlies the inner surface of the shell and which generally conforms to and is secured to the shell, the liner being made of a felt fabric of a temperature-resistant aromatic polyamide fiber. In the most preferred embodiment, the glove also includes a generally tubular wristlet or wrist cuff which has one end secured, as by sewing, to the shell and in generally encircling relation to the opening in the shell for insertion of the wearer's hand.

DESCRIPTION OF THE PREFERRED EMBODIMENT

The term "glove," as used herein, is intended to mean a conventional glove, a mitt, a mitten or any similar type wearing apparel for the hand. Thus, the present invention is directed not only to gloves provided with individual fingerstalls and a thumbstall but also hand apparel of the type wherein there are no individual fingerstalls but a thumbstall or wherein there are neither fingerstalls nor a thumbstall.

Figure 1:
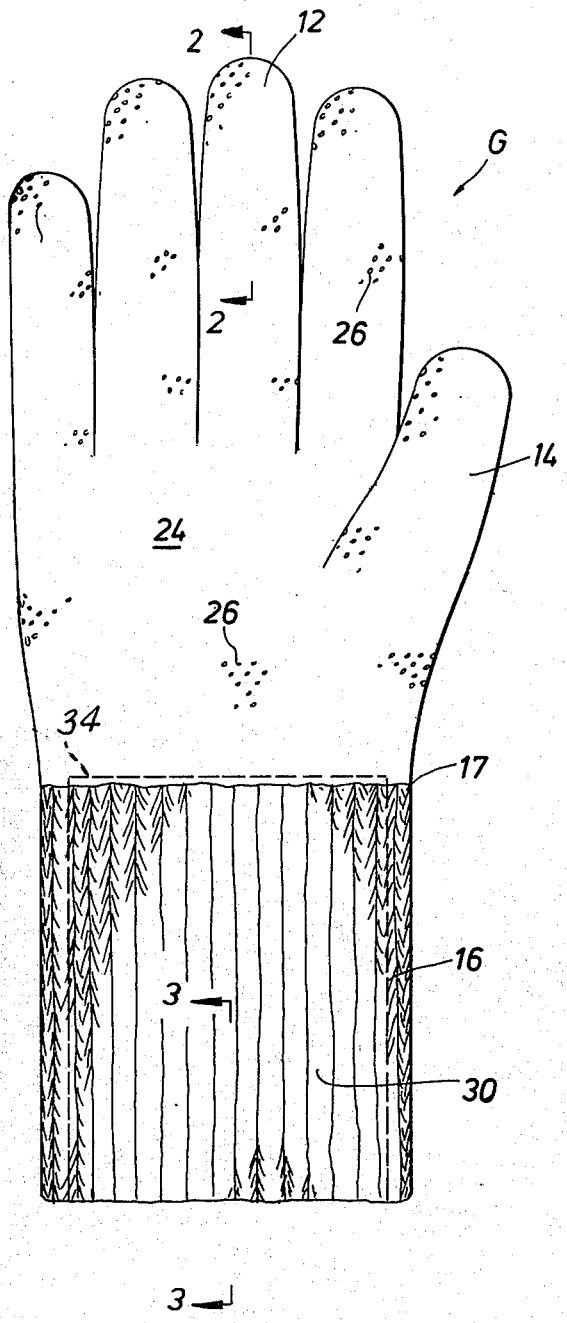
FIG. 1 is a front, elevational view of a protective glove constructed in accordance with the present invention.

Referring first to FIG. 1, the glove G is seen to have the usual fingerstalls 12, a thumbstall 14 and wrist cuff or wristlet 16. FIG. 1 shows the palm side of glove G, the backside not being shown.

Figure 2:
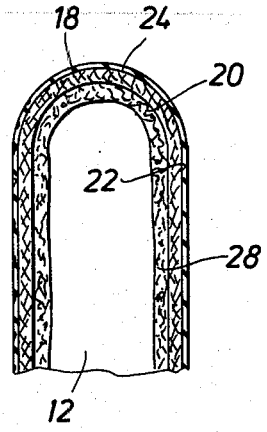
FIG. 2 is a fragmental sectional view, on an enlarged scale, taken on the lines 2—2 of FIG. 1.

Referring now to FIG. 2, it can be seen that glove G has a shell 18 which generally forms the desired configuration of the glove G, including the palm side and the backside, and an opening for insertion of the wearer's hand, the opening being generally defined by an adjoining seam 17 between the body of glove G and wristlet 16. While as shown in FIG. 2, shell 18 is of a single piece construction, it will be understood that such is for purposes of illustration only and that shell 18 can be formed generally of two halves, one half forming a palm side, the other half forming a backside, the two halves being joined along their peripherally extending edges by a suitable technique such as sewing. Such a configuration is shown generally in co-pending application Ser. No. 393,581, filed 6-30-82. Shell 18 is comprised of a fabric of a temperature-resistant aromatic polyamide fiber, a particularly desirable fiber being manufactured by the DuPont Company and sold under the trademark "Kevlar." Shell 18 is also preferably comprised of a tight, twill weave fabric of the polyamide fiber, the twill weave providing greater wear qualities than other forms of fabric construction such as knits, felts and the like and being less susceptible to snagging.

Shell 18 has an inner surface 20 and an outer surface 22, outer surface 22 being coated with a flame-resistant elastomeric coating 24. The elastomeric coating 24, which generally will be from about 4 to about 5 mils in thickness, is preferably a neoprene elastomer, but can be any elastomeric material which has similar flexibility, and heat and flame-resistant properties as those of neoprene and which therefore aid in preventing conductive heat penetration through glove G.

In the preferred embodiment, the palm side of glove G is provided with a friction inducing surface to improve the gripping qualities. Such a surface, shown as 26 in FIG. 1, can be provided by a roughened surface on coating 24, e.g. by waffling or dimpling, by incorporating in coating 24 small particles of an insoluble material which will cause an irregular surface on coating 24, or similar such methods.

It is also preferable that coating 24 contain a pigmenting material which possesses heat reflecting qualities so as to provide better protection against radiant heat penetration. Accordingly, fire-resistant materials which can pigment the coating yellow, white or other light colors which tend to reflect heat are particularly desirable.

Again referring to FIG. 2, secured to the shell 18 inwardly thereof is a liner 28 which overlies the inner surface 20 of shell 18. In the preferred case, the liner 28 comprises a felt fabric of a temperature-resistant aromatic polyamide fiber, such as Kevlar. The felt fabric of liner 28 provides both puncture resistance and thermal insulation. It will be appreciated that liner 28 will generally conform to and be secured to the shell 18 by well known methods such as sewing the liner 28 to shell 18 at suitable strain locations in the glove construction. Reference is again made to co-pending application Serial No. 393,581, filed 6-30-82 noted above, which discloses a suitable method of construction of a glove having a shell such as shell 18 and a liner such as liner 28. Although the felt fabric used in forming the liner 28 can be of various weights per unit square area, it is preferred to use a Kevlar felt having a weight per unit square area of about 3.5 oz./sq.yd.

Although optional, it is preferable that glove G be provided with the wristlet 16 which, as will be recognized, will be generally tubular in configuration, one end of which will be attached to glove G at seam 17 in generally encircling relation to the opening in glove G for insertion of the wearer's hand.

Figure 3:
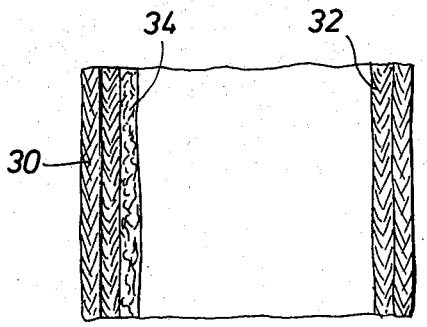
FIG. 3 is a fragmental sectional view, on an enlarged scale, taken on the lines 3—3 of FIG. 1.

Referring now to FIG. 3, it can be seen that wristlet 16 has an outermost layer 30 of a knitted fabric of a temperature-resistant aromatic polyamide fiber such as Kevlar and an inner layer 32 of a fabric which is resistant to strike-through or bleed of the elastomeric coating 24. Inner layer 32, since it is not generally exposed directly to flame or heat, does not have to be made from heat-resistant fabrics such as fabrics of Kevlar fiber or similar material but, as noted, can be of any fabric which will prevent strike-through of the elastomeric coating 24. A suitable such material is a knitted cotton fabric, although other fabrics can be used as well. It is preferred that both outermost layer 30 and inner layer 32 be of knit construction to permit stretching and thereby act as a resilient seal around the wrist of the wearer to prevent the ingress of water into the interior of the glove G. Outermost layer 30 and inner layer 32 can be secured to one another and to the body of glove G by suitable sewing techniques and it is especially desirable to use heat and fire-resistant thread such as Kevlar thread in constructing the glove.

Secured to the inner layer 32 of wristlet 16 is a patch 34 of a felt fabric of a temperature-resistant aromatic polyamide fiber such as Kevlar, patch 34 being positioned generally on the palm side of glove G (See FIG. 1). Patch 34, being temperature resistant, provides further protection for the wearer's wrists against heat, puncture or cutting.

To demonstrate the utility of the glove of the present invention, it was subjected to appropriate NIOSH test procedures. The results are shown in the table below.

TABLE

| NIOSH* Test | NIOSH Criteria | Performance Rating |
|---|---|---|
| Cut Resistance | No surface cut @ 16 lbs | Pass |
| Puncture Resistance | 13.2 lbs minimum | 25 lbs |
| Resistance to Conductive Heat Penetration | Not to exceed injury threshold temperature for 5 seconds | >5 sec |
| Resistance to Radiant Heat Penetration | Not to exceed injury threshold temperature for 10 minutes | ½–1 min |
| Resistance to Flame | After-flame <2 sec<br>After-glow <2 sec<br>Visible char <1 in | Pass |
| Dexterity | Pick up 0.20 in diameter × 1.6 in long steel pin between thumb and each finger | Pass |

*National Institute for Occupational Safety and Health

As the results of the table above show, the coated gloves of the present invention are ideally suited for use as fire fighters' gloves. It should also be recognized that the gloves are equally suited for use by other workers such as foundry workers and the like whose hands are subjected to excessive temperatures and may also come in contact with objects or workpieces which can puncture or cut the hand of the wearer.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A heat-resistant, protective glove comprising:

a shell having an inner surface and an outer surface and generally defining a palm side, a backside, and an opening for insertion of a wearer's hand, said shell being made of a fabric of a temperature-resistant aromatic polyamide fiber;

a coating of a flame-resistant elastomer substantially covering the outer surface of said shell; and a liner generally conforming and secured to said shell, said liner overlying said inner surface of said shell and comprising a felt fabric of a temperature-resistant aromatic polyamide fiber.

2. The glove of claim 1 wherein said polyamide fiber comprises Kevlar.

3. The glove of claim 1 wherein said flame-resistant elastomer comprises neoprene.

4. The glove of claim 1 wherein said coating is pigmented with a material having a heat reflecting color.

5. The glove of claim 1 wherein the fabric of said liner has a weight per unit square area of 3.5 oz./sq.yd.

6. The glove of claim 1 including a generally tubular wristlet having one end secured to said shell and in generally encircling relation to said opening for insertion of said hand.

7. The glove of claim 6 wherein said wristlet comprises an outermost layer of a knitted fabric of a temperature-resistant aromatic polyamide fiber, an inner layer of a fabric resistant to strike-through of said coating, said inner layer being secured to said outermost layer and a patch of a felt fabric of a temperature-resistant aromatic polyamide fiber inwardly of and secured to said inner layer, said patch being positioned generally on the palm side of said glove.

8. The glove of claim 7 wherein said polyamide fiber is Kevlar.

9. The glove of claim 1 wherein said palm side is provided with a friction inducing surface.

* * * * *